US010170005B1

(12) United States Patent
Macek et al.

(10) Patent No.: US 10,170,005 B1
(45) Date of Patent: Jan. 1, 2019

(54) VEHICLE CONFLICT DETECTION

(71) Applicant: Honeywell International Inc., Morris Plains, NJ (US)

(72) Inventors: Karel Macek, Prague (CZ); Kameswararao Belamkonda, Andhra Pradesh (IN); Manuj Sharma, Karnataka (IN); Vit Libal, Prague (CZ)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/700,678

(22) Filed: Sep. 11, 2017

(51) Int. Cl.
*G08G 1/00* (2006.01)

(52) U.S. Cl.
CPC ..... *G08G 1/207* (2013.01)

(58) Field of Classification Search
CPC ..... G08G 1/00; G08G 1/20; G08G 1/205; G08G 1/207; G01C 21/28; G01C 21/34; G08C 1/3407; G01S 2205/002; G01S 2205/008
See application file for complete search history.

(56) References Cited

U.S. PATENT DOCUMENTS

| | | | | |
|---|---|---|---|---|
| 9,542,852 | B2 * | 1/2017 | Cross | G08G 9/00 |
| 2013/0204519 | A1 * | 8/2013 | Kandal | G01C 21/34 701/410 |
| 2014/0104081 | A1 * | 4/2014 | Cross | G08G 9/00 340/989 |
| 2014/0365246 | A1 * | 12/2014 | Hayward | G06Q 40/08 705/4 |
| 2017/0127231 | A1 * | 5/2017 | Patil | H04W 4/021 |

* cited by examiner

*Primary Examiner* — Van T Trieu
(74) *Attorney, Agent, or Firm* — Schwegman Lundberg & Woessner, P.A.

(57) ABSTRACT

Generally discussed herein are methods and apparatuses that can reduce conflicts in an area including vehicles. An apparatus can include transceiver circuitry, and conflict detection circuitry to receive a position of a vehicle in a geographical area that is segmented into discrete cells, determine whether the position is situated in a cell of the cells that includes a polygonal area representing an extended restricted area within the cell, and the extended restricted area completely within the polygonal area, in response to a determination the position is situated within the polygonal area, determine whether the position is situated within the extended restricted area, and in response to a determination the position is situated within the extended restricted area, provide one or more signals to the transceiver circuitry to cause the transceiver circuitry to transmit an alert to the vehicle indicating that a conflict exists.

20 Claims, 7 Drawing Sheets

VEHICLE CONFLICT DETECTION

BACKGROUND

Many geographical regions have vehicles and restricted areas in which the vehicles are not allowed to go. The vehicles can enter, knowingly or unknowingly, a restricted area. One such geographical region includes an airfield.

SUMMARY

In one or more embodiments, a device includes transceiver circuitry, conflict detection circuitry coupled to the transceiver circuitry, the conflict detection circuitry to: receive, from position determination circuitry, a position of a vehicle in a geographical area that is segmented into discrete cells, determine whether the position is situated in a cell of the cells that includes a polygonal area representing an extended restricted area within the cell, the extended restricted area including a footprint of a restricted area extended in one or more directions, and the extended restricted area completely within the polygonal area, in response to a determination the position is situated within the polygonal area, determine whether the position is situated within the extended restricted area, and in response to a determination the position is situated within the extended restricted area, provide one or more signals to the transceiver circuitry to cause the transceiver circuitry to transmit an alert to the vehicle indicating that a conflict exists.

In one or more embodiments, a system can include a memory including data regarding a geographical extent of a registered geographical area stored thereon, the data indicating a geographical extent of discrete cells of the registered geographical area, the data further indicating a geographical extent of a restricted area within the geographical area that a vehicle is prohibited from entering, the data further indicating a geographical extent of an extended restricted area within the geographical area that fully surrounds the geographical area, and the data further indicating a polygonal area within the geographical area that fully surrounds the extended restricted area, position determination circuitry to determine a position of the vehicle in the registered geographical area, and conflict determination circuitry to: determine, based on the position, to which cell of the discrete cells the position corresponds, determine if the determined cell includes at least a portion of the polygonal area therein, in response to a determination the position is situated within the polygonal area, determine whether the position is situated within the extended restricted area, and in response to a determination the position is situated within the extended restricted area, provide one or more signals to transceiver circuitry of the conflict detection circuitry to cause the transceiver circuitry to transmit an alert to the vehicle indicating that a conflict exists.

In one or more embodiments, a method can include receiving, at conflict detection circuitry and from position determination circuitry, a position of a vehicle in a geographical area that is segmented into discrete cells, determining, by the conflict detection circuitry, whether the position is situated in a cell of the cells that includes a polygonal area representing an extended restricted area within the cell, the extended restricted area including a footprint of a restricted area extended in one or more directions, and the extended restricted area completely within the polygonal area, in response to determining the position is situated within the polygonal area, determining whether the position is situated within the extended restricted area, and in response to determining the position is situated within the extended restricted area, providing one or more signals to transceiver circuitry to cause the transceiver circuitry to transmit an alert indicating that a conflict exists to the vehicle.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
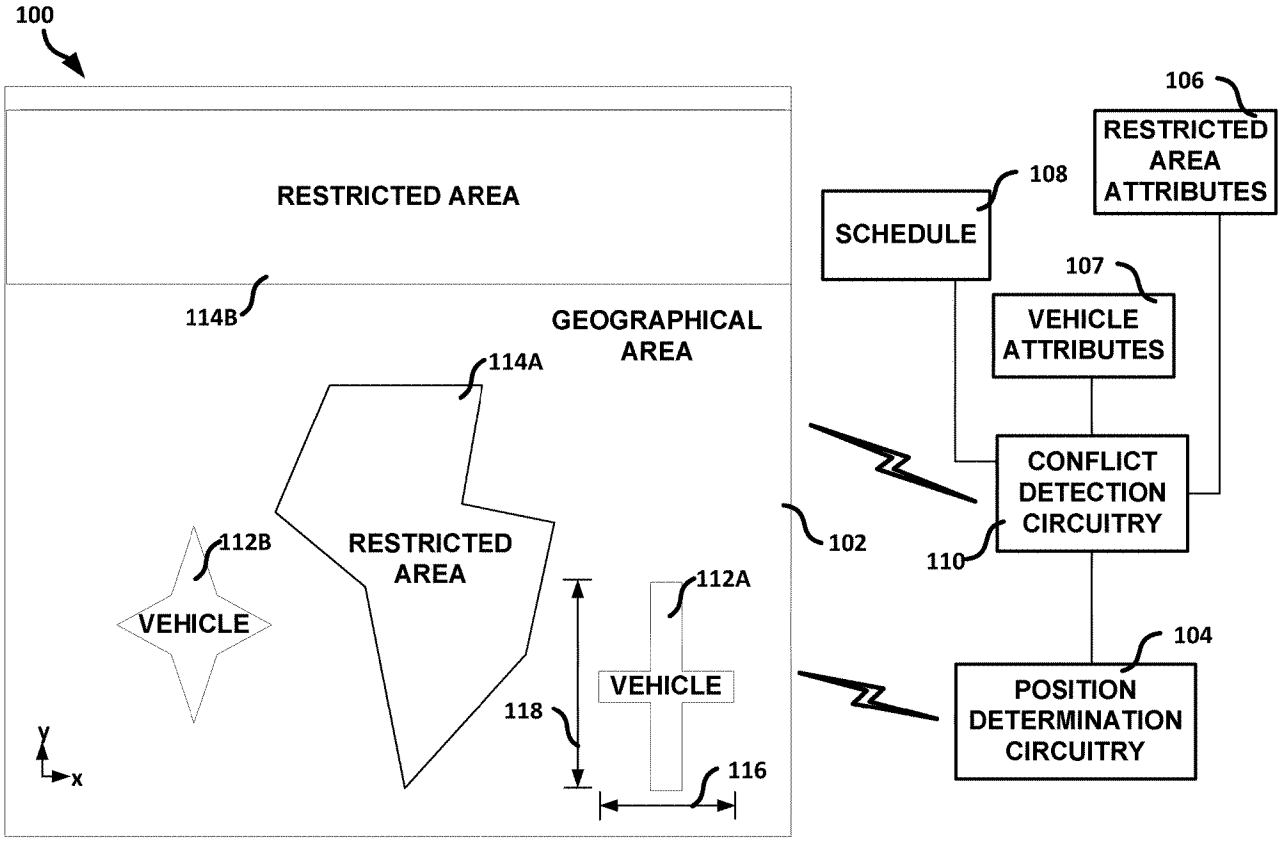
FIG. 1 illustrates, by way of example, a logical diagram of an embodiment of a conflict detection and/or alerting system.

Examples in this disclosure relate to apparatuses and systems that include conflict avoidance, such as in a geographical area that includes vehicles and areas that one or more of the vehicles are prohibited from entering. Examples also relate to techniques of using and implementing the conflict avoidance mechanisms.

Vehicles can be present and cause conflicts in a variety of areas. Such areas can include roads, tracks, airways, driveways, parking lots, parking garages, airports, and train stations, among others. Conflicts between vehicles and restricted areas can occur at any of these areas. Embodiments are described regarding an airport setting, but are equally applicable to other areas, such as those previously mentioned.

A goal of an Airport Surface Manager (SMAN) can include assuring smooth and safe operation on an airfield. The SMAN can help avoid conflicts between vehicles and restricted areas. The vehicles can include aircrafts, luggage handlers, towing vehicles, fuel dispensing vehicles (e.g., gas, anti-ice, or other fuel dispensing vehicles), and/or passenger vehicles (e.g., buses and other vehicles). Conflicts can occur when the aircraft is taxiing towards its takeoff or landing destination and other times.

On the airfield, several areas exist where one or more of the vehicles are not allowed to go (ever or at a specified time). Such areas are called restricted areas. There are a variety of different restricted areas. Some of the restricted areas are defined by construction properties (e.g., a corridor for bus or other vehicle travel cannot be used by aircraft).

Other restricted areas are defined in terms of time (e.g., cleaning or renovation), regions restricted due to a flight schedule (e.g., an area around an aircraft during its push-back, taxi, takeoff, or the like), and/or an object detected that causes a hazard condition (e.g., a vehicle or other object traveling at a speed above a specified threshold or the like).

One task of the SMAN can include providing an alert in response to determining a vehicle entered or is about to enter a restricted area. A vehicle in a restricted area can jeopardize aircraft passengers, other people in vehicles on the airfield, and/or people outside of vehicles on the airfield, such as baggage handlers, aircraft marshals, among others. This task is difficult for a variety of reasons, such as inexact position information of the vehicles, people on the airfield outside of vehicles, or other objects on the airfield. The inexact position can be due to measurement error in radar data, global positioning system (GPS), Galileo, image-based position estimate, or other position determination circuitry. Even if tools for getting more precise information from the data (e.g., Kalman filter) are used, a position estimate is provided with a variance. If multiple position measurement techniques are used (e.g., a combination of two or more of radar, GPS, cameras, or the like) and sensor fusion is used, the variance may be reduced, but generally remains non-zero. Further difficulty in determining position can be provided by restricted areas or vehicle footprints with nontrivial polygonal shapes. A time it takes to determine whether an object is within a restricted area is generally longer with more complex, nontrivial polygonal or non-polygonal shapes, as compared to more basic polygonal shaped objects (e.g., a rectangle, triangle, trapezoid, or the like).

Another difficulty can include having many vehicles on the airfield and/or many restricted areas. In such cases, computational efficiency can be reduced due to comparing position information for a vehicle to more restricted areas than in cases that include fewer restricted areas. Yet another difficulty can include providing an alert in timely manner, such as within a specified time before a conflict occurs. Providing the alert in a timely manner can force a conflict-detection technique to have a specified computing footprint (e.g., an amount of time it takes to detect a conflict and provide the alert to personnel operating a vehicle). In one or more embodiments, an amount of time it takes to determine a conflict exists, issue an alert, and receive the alert at the vehicle can be one hundred milliseconds or less, in one or more embodiments.

Embodiments will be described with reference to the FIGS. The embodiments discussed can overcome one or more of the difficulties previously mentioned, or others.

FIG. 1 illustrates, by way of example, a logical diagram of an embodiment of a conflict detection and/or alerting system 100. The system 100 as illustrated includes a geographical area 102, position determination circuitry 104, restricted area attributes 106, vehicle attributes 107, a schedule 108, and conflict detection circuitry 110. The geographical area 102 as illustrated includes vehicles 112A and 112B and restricted areas 114A and 114B therein.

The position determination circuitry 104 can determine a location and/or an extent of one or more of the vehicles 112A-112C and/or restricted areas 114A-114C. The position determination circuitry 104 can include one or more of a radar, GPS, Galileo, camera, and triangulation circuitry (e.g., using cellular, Wi-Fi, Bluetooth, radio frequency (RF), other frequency or standard signal(s), or a combination thereof, among others). The position determination circuitry 104 can determine a position (e.g., a location and/or extent) of the vehicles 112A-112C in a unified coordinate system to which images of the geographical area 102 are registered. The position provided by the position determination circuitry 104 can include an associated position error. The position and position error can be provided by the position determination circuitry 104 to the conflict detection circuitry 110. The position determined by the position determination circuitry 104 can be one or more points, such as latitude and longitude or an (x, y) coordinate within the registered space, for example.

Alternatively, the position error can be known by the conflict detection circuitry 110, and the position determination circuitry 104 can provide the position information, without the position error, to the conflict detection circuitry 110. The position determined by the position determination circuitry 104 can be one or more points, such as latitude and longitude or an (x, y) coordinate within the registered space, for example. The position can be used by the conflict detection circuitry 110 or position determination circuitry 104 to determine the position and a maximum possible extent of the vehicle 112A-112C in the geographical area 102.

The restricted area attributes 106 can include data regarding a footprint of restricted areas 114A-114C. The restricted area attributes 106 can further include data regarding a vehicle size that can pass through the restricted area 114A-114C (if any), such as in the case of a corridor, or the like. The restricted area attributes 106, can be static or dynamic. A restricted area attribute 106 corresponding to a corridor, building, or other permanent fixture type restricted area can be static. A restricted area attribute 106 corresponding to a schedule type restricted area can be dynamic. For example, if vehicle 112A is scheduled (as indicated by the schedule 108) to taxi to a gate or to a runway at a specified time, or takeoff, the restricted area can be dynamic. Another example of a dynamic restricted area includes an area in which the vehicles 112A-112B cannot enter due to maintenance. A restricted area can be defined for a specified time. After the specified time has elapsed, the dynamic restricted area can be removed from/changed in the restricted area attributes 106.

The vehicle attributes 107 can include data regarding a maximum extent of the vehicle 112A-112B. The maximum extent of the vehicle can include a maximum width/length (e.g., a largest width (e.g., wingspan) indicated by arrow 116 or length (dimension generally perpendicular to the wingspan) indicated by arrow 118). For example, if a first vehicle has a width of fifty meters and length of seventy-eight meters, and a second vehicle has a width of sixty meters and a length of one hundred meters, the maximum width/length is one hundred meters. In one or more other embodiments, the maximum width is the maximum extent.

The schedule 108 can include data regarding dynamic restricted area, such as one or more of the restricted areas 114A-114B. In the example of an airfield, the schedule 108 can indicate the a time the vehicle 112A-112B is scheduled to move (e.g., taxi, takeoff, or the like), a destination for the vehicle 112A-112B, a path for the vehicle 112A-112B, and/or a scheduled maintenance or cleaning. The schedule 108 can indicate a time frame in which a dynamic restricted area exists, such as to indicate a start time, end time, and/or a geographical extent of the dynamic restricted area.

The conflict detection circuitry 110 can use the position (and error) from the position determination circuitry 104, the restricted area attributes 106, the maximum extent of the vehicle from the vehicle attributes 107, and/or the dynamic restricted area data from the schedule 108, to determine whether a vehicle 112A-112B is in or about to enter a restricted area 114A-114B. To further explain techniques for determining whether a vehicle 112A-112B is in or is about to enter a restricted area 114A-114B reference is made to FIGS. 2-5.

Circuitry, such as the conflict detection circuitry 110 and/or position determination circuitry 104, can include one or more processing units (e.g., a central processing unit or other hardware processor, field programmable gate array (FPGA), system on a chip (SoC), or the like) and/or one or more electric or electronic components electrically coupled to perform operations. The circuitry can include electric or electronic components, such as can include one or more transistors, resistors, capacitors, inductors, modulators, demodulators, oscillators, phase locked loops, rectifiers, voltage and/or current regulators, logic gates (e.g., AND, OR, inverter, NAND, NOR, XOR, or the like), diodes, analog to digital converters, digital to analog converters, multiplexers, buffers, amplifiers, or the like.

Figure 2:
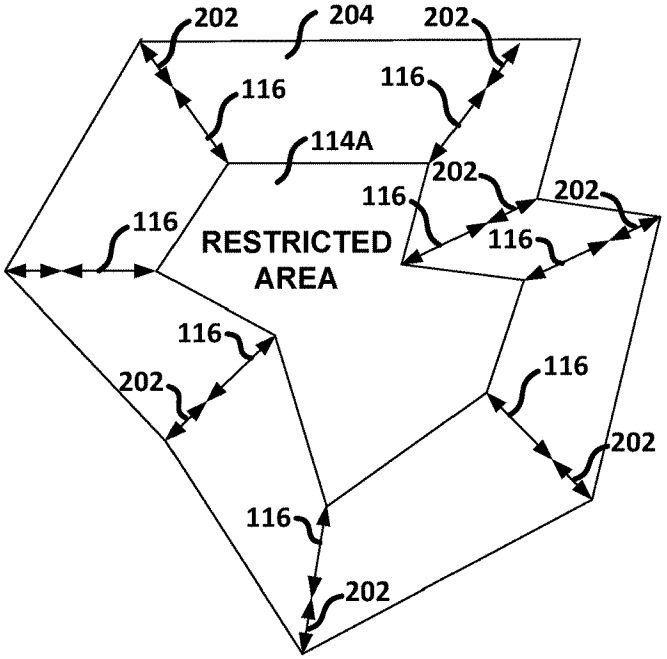
FIG. 2 illustrates, by way of example, a diagram of an embodiment of extending a footprint of the restricted area.

FIG. 2 illustrates, by way of example, a diagram of an embodiment of extending a footprint of the restricted area 114A. The restricted area 114A is extended to create an extended restricted area 204. The extended restricted area 204 can include the restricted area 114A expanded a specified amount in at least one direction. The extended restricted area 204 is illustrated as being extended in all directions. An example in which a restricted area 204 may be extended in less than all directions includes, for example, a building or other fixture that includes less than all sides with the geographical area 102.

An amount the footprint of the restricted area 114A is extended to create the extended restricted area 204 can include the maximum extent of the vehicle 112A-112B (in the example of FIG. 2, the maximum extent of the vehicle 112A-112B is represented by the width indicated by arrow 116, but may alternatively be represented by the length indicated by arrow 118). The amount the footprint is extended can further include a weighted location measurement error, indicated by arrow 202. The weighted measurement error can include a multiple of a determined measurement error multiplied by a weight. The weight, can be any positive real number. The weight, in one or more embodiments, can include the measurement variance multiplied by one, two, three, four, five, six, etc. For six-sigma quality control, the weight can be set to six. A total amount the footprint is extended in a given direction can be greater than or equal to the sum of the weighted position error and the maximum extent of the vehicle.

Figure 3:
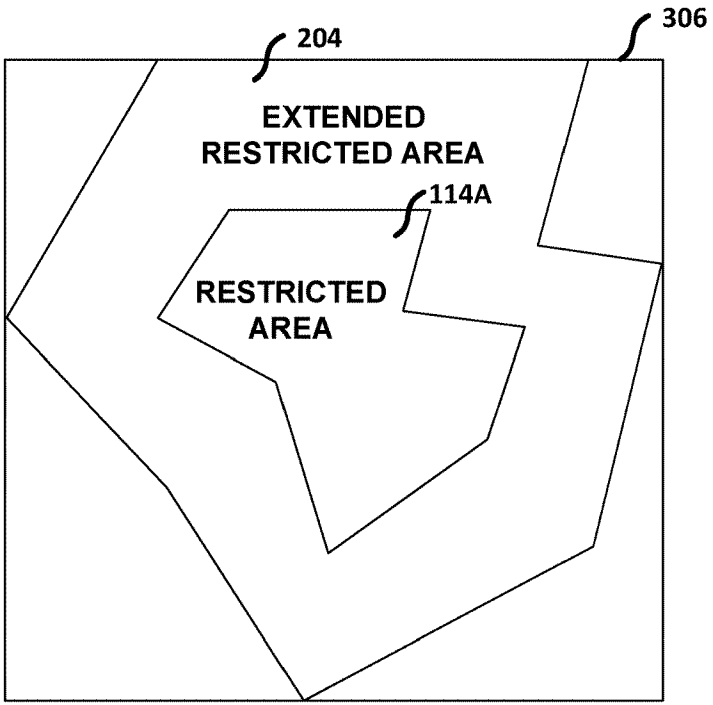
FIG. 3 illustrates, by way of example, a logical diagram of an embodiment of a basic polygon fit around the extended restricted area.

FIG. 3 illustrates, by way of example, a logical diagram of an embodiment of a polygonal area 306 that includes a basic polygon fit around the extended restricted area 204. The polygonal area 306 is illustrated as a rectangle, but can include another basic polygon shape, such as a triangle, trapezoid, pentagon, hexagon, heptagon, octagon, etc., or the like. The extended restricted area 204 can be contained entirely within the polygonal area 306. The polygonal area 306 may be used as a coarse filter for determining whether the vehicle 112A-112B has entered or is about to enter the restricted area 114A. The coarse filtering is described in the next paragraph and elsewhere herein. In one or more embodiments, a geographical extent of the extended restricted area 204, and a geographical extent of the polygonal area 306 can be stored with the restricted area attributes 106.

The conflict detection circuitry 110 can compare a position received from the position determination circuitry 104 to the geographical extent of the polygonal area 306 to determine whether the position is within the polygonal area 306. Such a calculation requires less compute time than determining whether the position is within the extended restricted area 204 for many restricted area shapes. In response to determining the position is not within the polygonal area 306, the conflict detection circuitry 110 can determine that no conflict exists and that no alert needs to be issued. In response to determining the position is within the polygonal area 306, the conflict detection circuitry 110 can further determine if the position is within the extended restricted area 204. In response to determining the position is not within the extended restricted area 204, the conflict detection circuitry 110 can determine that no conflict exists and no alert needs to be issued. In response to determining the position is within the extended restricted area 204, the conflict detection circuitry 110 can issue an alert.

Figure 4:
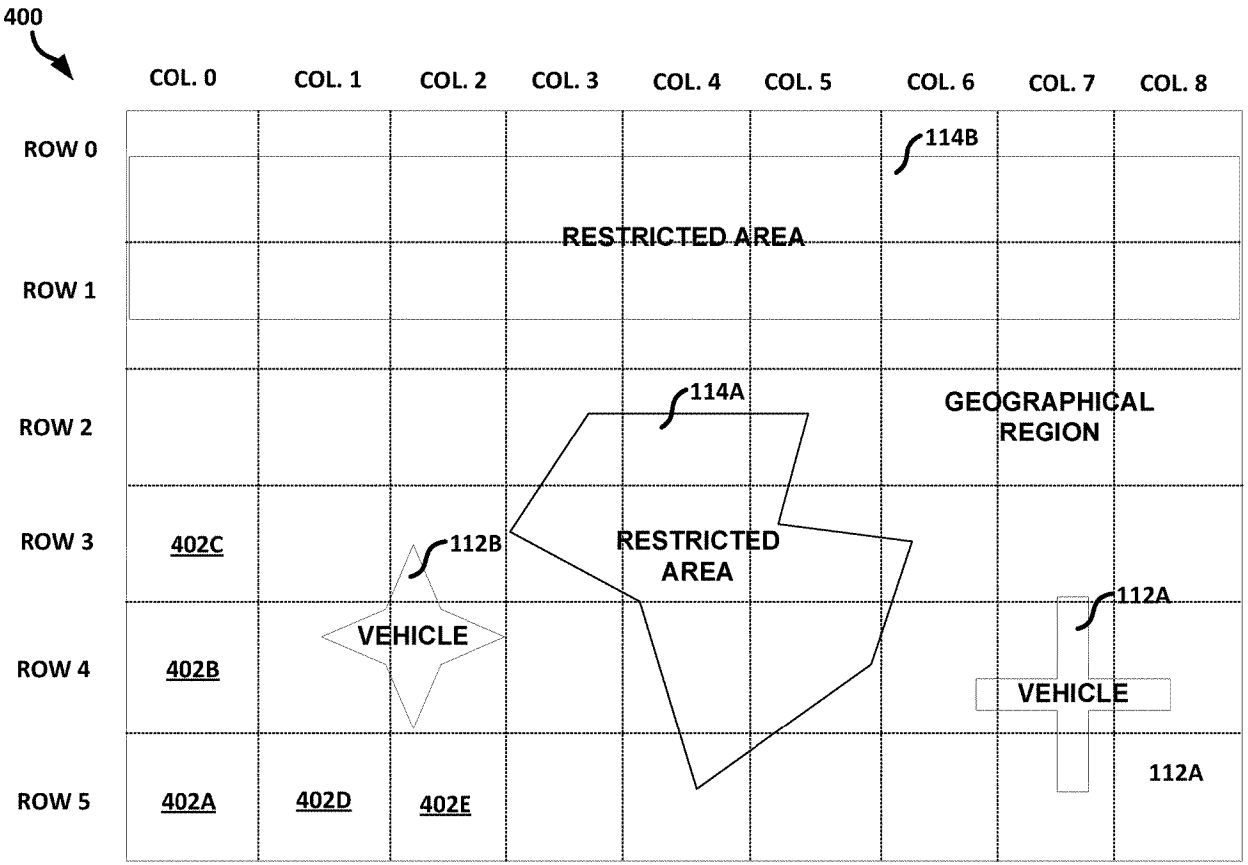
FIG. 4 illustrates, by way of example, a logical diagram of an embodiment of a registered and segmented geographical area.

FIG. 4 illustrates, by way of example, a logical diagram of an embodiment of a registered and segmented geographical area 400. The geographical area 400 can be registered, such as previously discussed. The registered geographical area can be segmented into multiple cells 402A, 402B, 402C, 402D, and 402E. Only a few of the cells 402A-402E are labeled in FIG. 4 to not obscure the view of other items in the geographical area 400. Each of the cells 402A-402E can be associated with a row and a column number, or other index. In the example of FIG. 4, the cell 402A is at (row 6, column 0); the cell 402B is at (row 5, column 0); and the cell 402E is at (row 6, column 2). The combination of all cells provides a grid for the geographical area 400.

Figure 5:
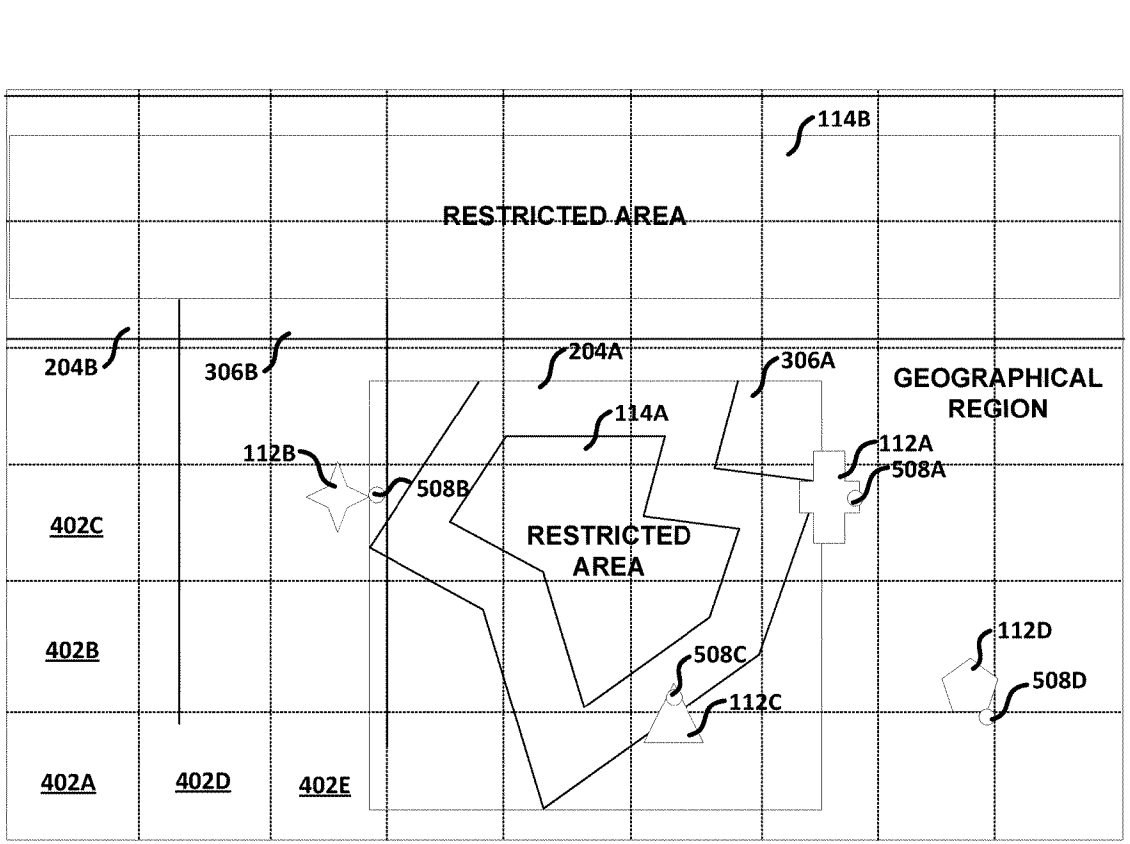
FIG. 5 illustrates, by way of example, a diagram of an embodiment of a registered and segmented geographical area.

FIG. 5 illustrates, by way of example, a diagram of an embodiment of a registered and segmented geographical area 500. The geographical area 500 includes restricted areas 114A-114B, extended restricted areas 204A and 204B, polygonal areas 306A and 306B, vehicles 112A, 112B, 112C, and 112D, and determined positions 508A, 508B, 508C, and 508D super-imposed thereon. In the embodiment of FIG. 5 the extended restricted area 204B and the polygonal area 306B have a same extent. This is because the restricted area 114B includes a simple polygonal footprint, rather than a more complex footprint like the restricted area 114A.

In determining whether a vehicle 112A-112D is in or near a restricted area 114A-114B, the conflict detection circuitry 110 can receive, from the position determination circuitry 104 the position 508A, 508B, 508C, and 508D of the vehicles 112A-112D, respectively. The conflict detection circuitry 110 can determine the cell of the geographical area 500 in which the position 508A-508D resides. In the embodiment of FIG. 5, the position 508A is in (row 3, column 6), the position 508B is in (row 3, column 2), the position 508C is in (row 1, column 5), and the position 508D is in (row 0, column 7). The conflict detection circuitry 110 can query the restricted area attributes 106 and/or schedule 108, to determine whether a polygonal area exists in the cell in which the position 508A-D resides. In the embodiment of FIG. 5, the position 508D is the only position located in a cell that includes no polygonal areas. In the embodiment of FIG. 5, each of the positions 508A-508C are located in cells in which the polygonal area 306A resides.

The conflict detection circuitry 110 can determine whether the positions 508A-508C are within the polygonal area 306A. While the vehicle 112A is partially within the polygonal area 306A, the position 508A provided to the conflict detection circuitry 110 indicates the vehicle 112A is not within the polygonal area 306A. In such a case, the conflict detection circuitry 110 can do no further processing and determine there is no conflict with the vehicle 112A. The vehicle 112A is within the polygonal area 306A, but is detected as being out of the polygonal area 306A is not an issue if the extended restricted area is sized to account for a maximum extent of the vehicle 112A and position measurement error.

While the vehicle 112B is outside the polygonal area 306A, the position 508B provided by the position determination circuitry 104 indicates the vehicle 112B is within the polygonal area 306A. In such a case, the conflict detection circuitry 110 can further determine whether the position 508B is within the extended restricted area 204A. In this instance, the position 508B is outside the extended restricted area 204A. In such an instance, the conflict detection circuitry does not issue an alert to the vehicle 112B.

The vehicle 112C is within the polygonal area 306A and the position 508C provided by the position determination circuitry 104 indicates the same. As in the previous case, the position determination circuitry 104 can determine whether the position is within the extended restricted area 204A. In this case, the position 508C is within the extended restricted area 204A. In such a case, the conflict detection circuitry 110 can issue an alert to the vehicle 112C. The alert can include a communication that causes a light to be turned on in the vehicle 112C (e.g., flash on and oft), a noise to be created within the vehicle 112C, such as a loud noise, a recorded message, or the like. The alert can be designed to get the attention of personnel operating the vehicle 112C.

FIG. 5 illustrates there can be true positives, true negatives, false positives, and false negatives in the process of determining whether a conflict exists. False negatives are a problem, as they can result in no alert being sent to a vehicle that should be alerted. Such false negatives can result in a collision. To reduce a probability of a collision, the extent to which the extended restricted area 204A-204B is enlarged relative to the restricted area 114A-114B can be made greater. If a higher risk of collision between the vehicles 112A-112D and the restricted area 114A-114B is tolerable, the extent to which the extended restricted area 204A-204B is extended relative to the restricted area 114A-114B can be reduced.

Figure 6:
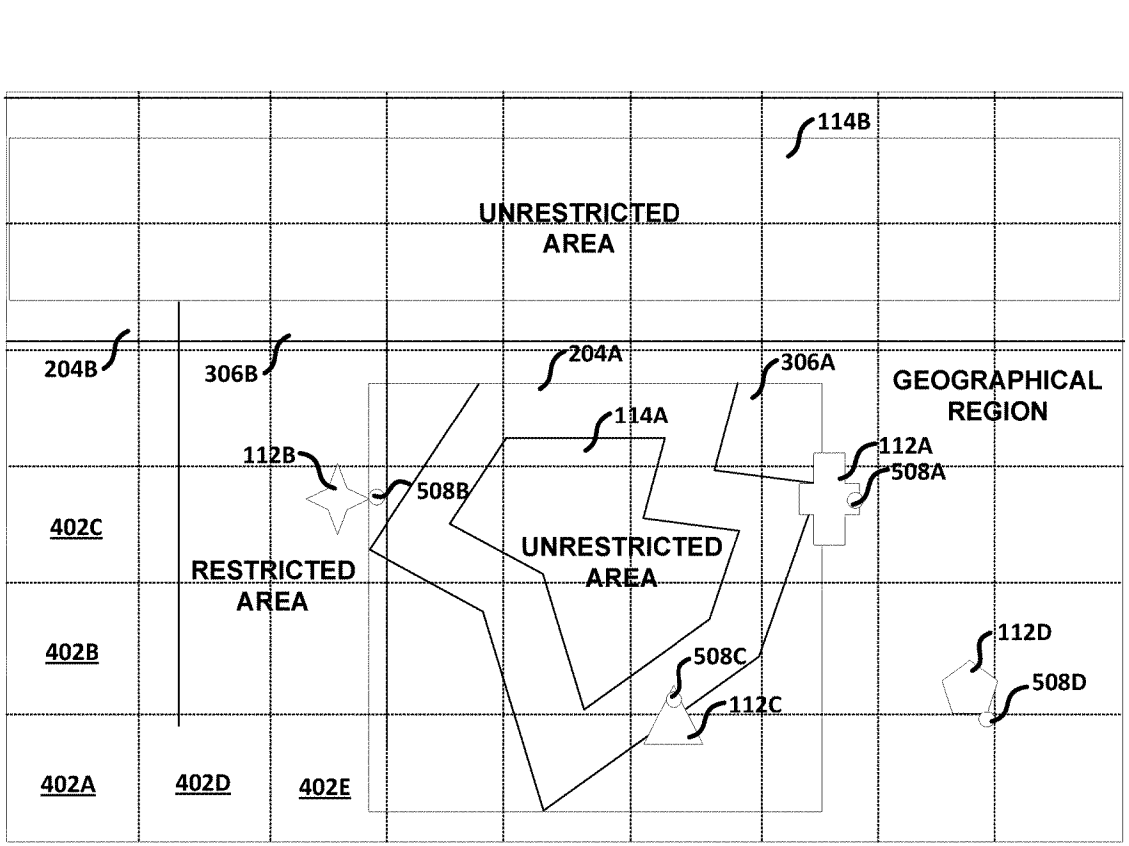
FIG. 6 illustrates, by way of example, an embodiment of an inverted geographical area.

FIG. 6 illustrates, by way of example, an embodiment of an inverted geographical area 600. The inverted geographical area 600 includes all the items of the geographical area 500 with each item that was previously associated with a restricted area (e.g., the restricted area 114A-114B, the extended restricted area 204A-204B, and the polygonal area 306A-306B) inverted to be unrestricted areas and areas previously associated with an unrestricted area inverted to be restricted areas.

The conflict detection circuitry 110 can determine, based on position information provided by the position determination circuitry 104 that a general threat exists in the inverted geographical area 600. The general threat can include an object travelling at an excessive speed in an unrestricted area. In response to determining the threat exists, the conflict detection circuitry 110 can treat areas associated with restricted areas as unrestricted and areas associated with unrestricted areas as restricted areas. In this manner, the conflict detection circuitry 110 can send an alert to all vehicles that are not determined to be in the one or more of the polygonal area 306A-306B and the extended restricted areas 204A-204B.

In the embodiment of FIG. 6, the conflict detection circuitry 110, in response to determining that a threat exists, can provide the alert to the vehicles 112A-112B and/or 112D. For example, if a heuristic indicates to provide an alert to all vehicles determined to be outside extended restricted areas, the conflict detection circuitry 110 can issue an alert to the vehicles 112A, 112B, and 112D. In another example, if a heuristic indicates to provide an alert to all vehicles determined to be outside polygonal areas, the conflict detection circuitry 110 can issue an alert to the vehicles 112A and 112D.

Figure 7:
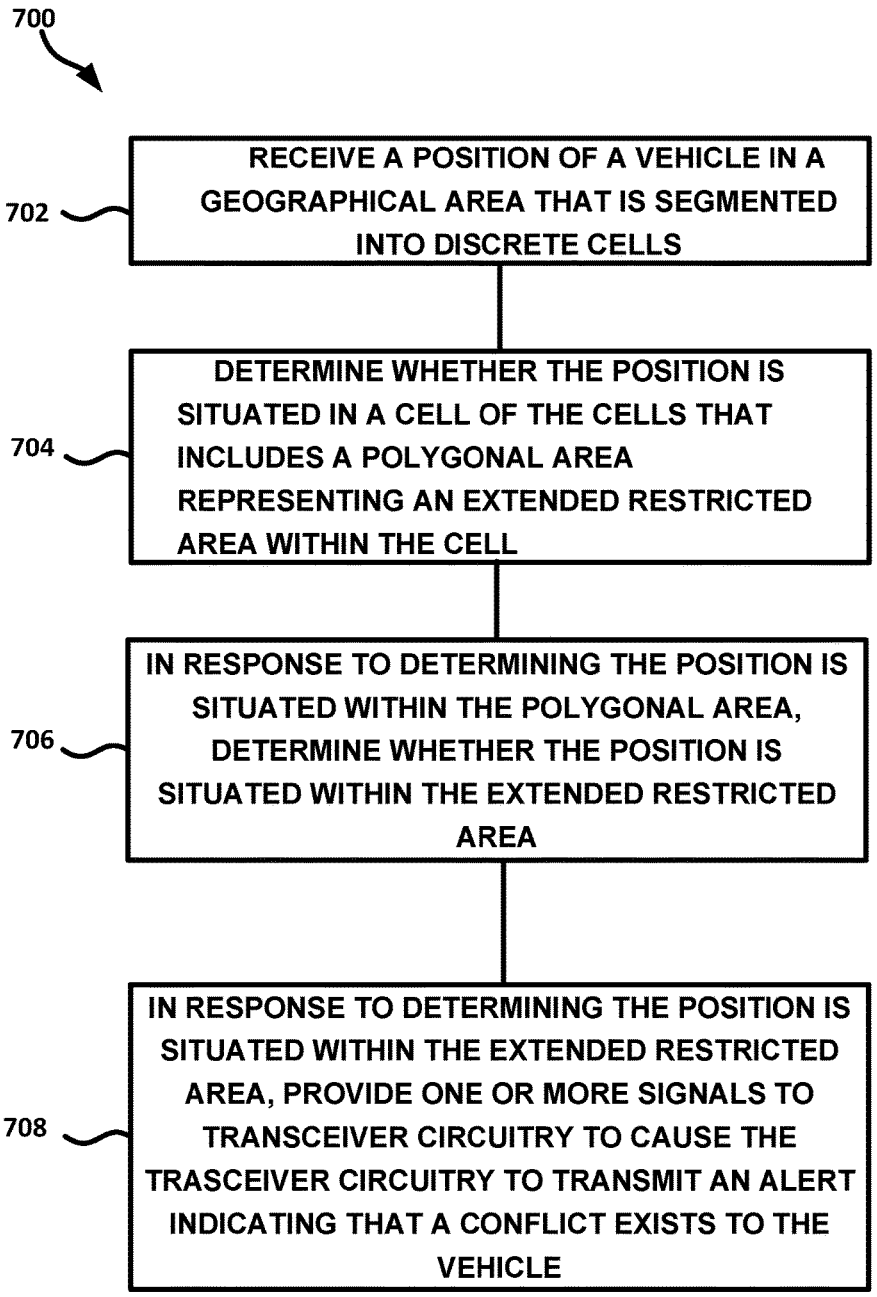
FIG. 7 illustrates, by way of example, an embodiment of a method for conflict detection and/or avoidance.

FIG. 7 illustrates, by way of example, an embodiment of a method 700 for conflict detection and/or avoidance. The method 700 as illustrated includes: receiving a position of a vehicle in a geographical area that is segmented into discrete cells, at operation 702; determining whether the position is situated in a cell of the cells that includes a polygonal area representing an extended restricted area within the cell, at operation 704; in response to determining the position is situated within the polygonal area, determining whether the position is situated within the extended restricted area, at operation 706; and in response to determining the position is situated within the extended restricted area, providing one or more signals to transceiver circuitry to cause the transceiver circuitry to transmit an alert indicating that a conflict exists to the vehicle, at operation 708. The operation 702 can be performed by the conflict detection circuitry 110 and the position can be received from the position determination circuitry 104. The extended restricted area can include a footprint of a restricted area extended in one or more directions. The extended restricted area can be completely within the polygonal area. The operations 704, 706, and 708 can be performed by the conflict detection circuitry 110.

The method 700 can further include, in response to determining the position is not situated in the polygonal area, determining (by the conflict detection circuitry 110) that no conflict exists. The method 700 can further include, in response to determining the position is not situated in the extended restricted area, determining (by the conflict detection circuitry 110) that no conflict exists. The extended restricted area can include the restricted area extended in all directions a distance that is greater than, or equal to, (a) a maximum width or a maximum length of all vehicles in the geographical area plus (2) an error in the received position weighted by a safety factor.

The polygonal area can include a rectangle (or another basic polygon footprint). The basic polygon can intersect points defined by a minimum and maximum location of the extended restricted area in a first direction and a minimum and maximum location of the extended restricted area in a second direction, the second direction perpendicular to the first direction, such as to intersect the furthest extents of the basic polygon in the x and y directions.

The method 700 can further include determining, based on the provided position, that a threat to other vehicles exists in the geographical area. The method 700 can further include, in response to determining the threat exists, producing one or more signals that cause the transceiver circuitry to provide an alert to all vehicles in the geographical area that are not completely within an extended geographical area of the geographical area.

The method 700 can further include enlarging the restricted area to form the extended restricted area. As mentioned previously, a position provided by the position determination circuitry 104 is estimated within a certain accuracy (e.g., a variance or standard deviation that is non-zero). To help assure a potential conflict is alerted, at least with a certain probability, the restricted area can be extended by a distance that corresponds to the error in the provided position. For example, if the standard deviation of the position estimate is three meters, the restricted area can be extended by eighteen meters (in all directions within the geographical area), such as to help assure six sigma precision. Since the variance evolves over time, a typical variance value for position determination circuitry 104 can be used. A situation can occur in which the variance is larger than the typical variance value and can cause a conflict that is not alerted. Using a more conservative value for variance (a larger variance value) can help assure detection and alert of conflicts.

The method 700 can further include further enlarging the restricted area to form the extended restricted area. The restricted area can be enlarged with respect to the size of the vehicle (e.g., up to forty or more meters for aircrafts with large wingspan). Since this parameter is specific for different types of vehicles, different extended restricted areas can be defined for different vehicles. When the position estimate of the position is in the enlarged area, the conflict may have occurred. By extending the restricted area based on vehicle attribute(s) and measurement accuracy, a probability of undetected conflicts can be below a certain threshold (e.g., 0.01%, greater than 0.01%, or less than 0.01%). The greater the threshold, the fewer number of conflicts that will be detected (generally) and the smaller the threshold, the greater the number of conflicts that will be detected (generally).

The method 700 can further include registering the geographical area to a grid of cells. Such a grid of cells can aid in reducing an amount of time it takes to determine whether a conflict exists. The cells can combine to encompass the entire geographical area. The cells can be non-overlapping and contiguous with one or more other cells. Each of the cells can include a basic polygonal shape (e.g., a basic polygonal shape described elsewhere). Each of the cells can include a corresponding key, that can be used to identify the cell. Each of the restricted areas, extended restricted areas, and/or polygonal areas can include keys. Each of the restricted areas, extended restricted areas, and/or polygonal areas overlap with one or more cells of the grid of cells. Each cell within the grid with which each of the restricted areas, extended restricted areas, and/or polygonal areas overlaps can be associated, such as by index in a lookup table that includes pointers to data, the data itself, or the like. Thus, each each grid cell (e.g., a 50 meter by 50 meter area or other area) can be associated with all enlarged polygonal areas, extended restricted areas, and/or restricted areas within the geographical area which the grid cell covers. The extent of the restricted areas, extended restricted areas, or polygonal areas can be provided as vertices under the assumption that borders of the areas are represented by straight lines between the vertices. Registration of the geographical area can include decomposition into convex areas (e.g., trapezoidal decomposition). Such decomposition can help accelerate the testing of the presence in the area.

The method 700 can include, after the restricted areas are extended and registered, the data from the position determination circuitry 104 and other components can be used to test for conflicts, such as presence of vehicles in the polygonal, restricted, or extended restricted areas. The vehicles can be processed one by one or in parallel, such as for a conflict. For each of the vehicles, a point estimate of the position, from the position determination circuitry 104, of the vehicle can be used. The method 700 can include determining a grid cell in which the position estimate is located. The method 700 can include determining whether there are any relevant restricted, extended restricted, or polygonal areas in the determined grid cell. If no such areas are within the grid cell, there is no conflict, and the conflict detection circuitry 110 can move to the next test. If such an area is within the grid cell, further testing, by the conflict detection circuitry 110, can be performed to determine if a conflict exists, such as by performing operations described previously.

The method 700 can include determining that a variance of a position measurement is above a threshold. The threshold can be determined based on a desired probability of detecting a conflict. In such a situation, it may not be possible to perform conflict detection within the desired probability. The method 700 can include providing an alert to a vehicle indicating that the conflict detection may not be operating properly and/or to use extra caution in moving.

Figure 8:
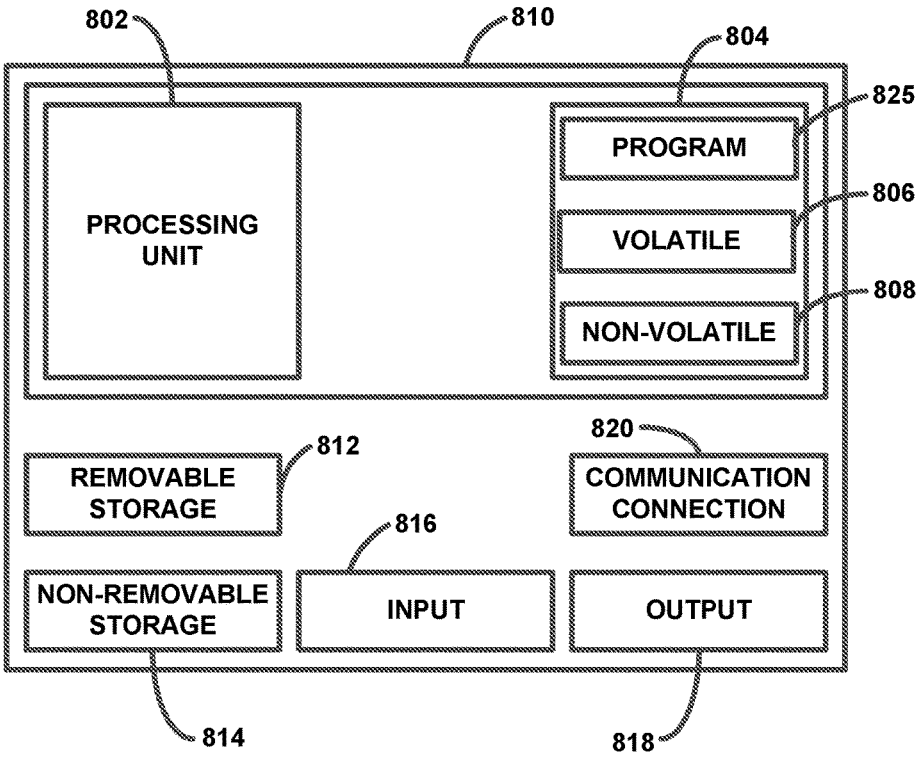
FIG. 8 illustrates, by way of example, a block diagram of an embodiment of a computing device.

FIG. 8 illustrates, by way of example, a block diagram of an embodiment of a computing device. One or more of the foregoing embodiments of position determination circuitry 104, conflict detection circuitry 110, or other circuitry or devices can include at least a portion of a computing system, such as computing system 800 of FIG. 8. One or more of the restricted area attributes 106, vehicle attributes 107, and schedule 108 can be stored in a memory, such as a memory 804. In one or more embodiments, multiple such computer systems are utilized in a distributed network to implement multiple components in a transaction based environment. An object-oriented, service-oriented, or other architecture may be used to implement such functions and communicate between the multiple systems and components. One example computing device in the form of a computer 810 may include a processing unit 802, memory 804, removable storage 812, and non-removable storage 814. Memory 804 may include volatile memory 806 and non-volatile memory 808. Computer 810 may include—or have access to—a computing environment that includes—a variety of computer-readable media, such as volatile memory 806 and non-volatile memory 808, removable storage 812 and non-removable storage 814. Computer storage includes random access memory (RAM), read only memory (ROM), erasable programmable read-only memory (EPROM) & electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage or other magnetic storage devices, or any other medium capable of storing computer-readable instructions. Computer 810 may include or have access to a computing environment that includes input 816, output 818, and a communication connection 820. The computer may operate in a networked environment using a communication connection to connect to one or more remote computers, such as database servers. The remote computer may include a personal computer (PC), server, router, network PC, a peer device or other common network node, or the like. The communication connection may include a Local Area. Network (LAN), a Wide Area Network (WAN) or other networks.

Computer-readable instructions stored on a machine-readable storage device are executable by the processing unit 802 of the computer 810. A hard drive, CD-ROM, and RAM are some examples of articles including a non-transitory computer-readable medium. For example, a computer program 825 capable of providing instructions, which when executed by the processing unit 802 or other machine capable of executing the instructions, cause the processing unit to perform allocation or assignment of PCI based on a location of a small cell, such as a small cell that is being deployed. The instructions can be saved on a CD-ROM and loaded from the CD-ROM to a hard drive of the computer 810. The computer-readable instructions can allow the computer 810 (e.g., the processing unit 802) to implement the conflict detection, conflict avoidance, position determination, alert issuance, or other operations or methods.

ADDITIONAL NOTES AND EXAMPLES

The present subject matter can be described by way of several examples.

Example 1 can include or use subject matter (such as an apparatus, a method, a means for performing acts, or a device readable memory including instructions that, when performed by the device, can cause the device to perform acts), such as can include or use a device comprising transceiver circuitry, conflict detection circuitry coupled to the transceiver circuitry, the conflict detection circuitry to: receive, from position determination circuitry, a position of a vehicle in a geographical area that is segmented into discrete cells, determine whether the position is situated in a cell of the cells that includes a polygonal area representing an extended restricted area within the cell, the extended restricted area including a footprint of a restricted area extended in one or more directions, and the extended restricted area completely within the polygonal area, in response to a determination the position is situated within the polygonal area, determine whether the position is situated within the extended restricted area, and in response to a determination the position is situated within the extended restricted area, provide one or more signals to the transceiver circuitry to cause the transceiver circuitry to transmit an alert to the vehicle indicating that a conflict exists.

Example 2 can include or use, or can optionally be combined with the subject matter of Example 1, to optionally include or use, wherein the conflict detection circuitry is further to, in response to a determination the position is not situated in the polygonal area, determine that no conflict exists.

Example 3 can include or use, or can optionally be combined with the subject matter of at least one of Examples 1-2, to optionally include or use, wherein the conflict detection circuitry is further to, in response to a determination the position is not situated in the extended restricted area, determine that no conflict exists.

Example 4 can include or use, or can optionally be combined with the subject matter of at least one of Examples 1-3, to optionally include or use, wherein the conflict detection circuitry is to retrieve data indicating the extent of the polygonal area from a local memory.

Example 5 can include or use, or can optionally be combined with the subject matter of at least one of Examples 1-4, to optionally include or use, wherein the extended restricted area includes the restricted area extended in all directions a distance that is greater than, or equal to, (a) a maximum width or a maximum length of all vehicles in the geographical area plus (2) an error in the received position weighted by a safety factor.

Example 6 can include or use, or can optionally be combined with the subject matter of at least one of Examples 1-5, to optionally include or use, wherein the polygonal area is a rectangle including points defined by a minimum and maximum location of the extended restricted area in a first direction and a minimum and maximum location of the extended restricted area in a second direction, the second direction perpendicular to the first direction.

Example 7 can include or use, or can optionally be combined with the subject matter of at least one of Examples 1-6, to optionally include or use, wherein the conflict detection circuitry is further to determine, based on the provided position, that a threat to other vehicles exists in the geographical area, and in response to the determination the threat exists, produce one or more signals that cause the transceiver circuitry to provide an alert to all vehicles in the geographical area that are not completely within an extended geographical area of the geographical area.

Example 8 can include or use subject matter (such as an apparatus, a method, a means for performing acts, or a device readable memory including instructions that, when performed by the device, can cause the device to perform acts), such as can include or use a system comprising a memory including data regarding a geographical extent of a registered geographical area stored thereon, the data indicating a geographical extent of discrete cells of the registered geographical area, the data further indicating a geographical extent of a restricted area within the geographical area that a vehicle is prohibited from entering, the data further indicating a geographical extent of an extended restricted area within the geographical area that fully surrounds the geographical area, and the data further indicating a polygonal area within the geographical area that fully surrounds the extended restricted area, position determination circuitry to determine a position of the vehicle in the registered geographical area, and conflict determination circuitry to determine, based on the position, to which cell of the discrete cells the position corresponds, determine if the determined cell includes at least a portion of the polygonal area therein, in response to a determination the position is situated within the polygonal area, determine whether the position is situated within the extended restricted area, and in response to a determination the position is situated within the extended restricted area, provide one or more signals to transceiver circuitry of the conflict detection circuitry to cause the transceiver circuitry to transmit an alert to the vehicle indicating that a conflict exists.

Example 9 can include or use, or can optionally be combined with the subject matter of Example 8, to optionally include or use, wherein the conflict detection circuitry is further to, in response to a determination the position is not situated in the polygonal area, determine that no conflict exists.

Example 10 can include or use, or can optionally be combined with the subject matter of at least one of Examples 8-9, to optionally include or use, wherein the conflict detection circuitry is further to, in response to a determination the position is not situated in the extended restricted area, determine that no conflict exists.

Example 11 can include or use, or can optionally be combined with the subject matter of at least one of Examples 8-10, to optionally include or use, wherein the extended restricted area includes the restricted area extended in all directions a distance that is greater than, or equal to, (a) a maximum width or a maximum length of all vehicles in the geographical area plus (2) an error in the position weighted by a safety factor.

Example 12 can include or use, or can optionally be combined with the subject matter of at least one of Examples 8-11, to optionally include or use, wherein the polygonal area is a rectangle including points defined by a minimum and a maximum location of the extended restricted area in a first direction within the geographical area and a minimum and a maximum location of the extended restricted area in a second direction, the second direction perpendicular to the first direction.

Example 13 can include or use, or can optionally be combined with the subject matter of at least one of Examples 8-12, to optionally include or use, wherein the extended restricted area is one of a plurality of extended restricted areas and wherein the conflict detection circuitry is further to determine, based on the position, that a threat to other vehicles exists in the geographical area, and in response to the determination the threat exists, produce one or more signals that cause the transceiver circuitry to provide an alert to all vehicles in the geographical area that are not completely within an extended restricted area of the extended restricted areas.

Example 14 can include or use, or can optionally be combined with the subject matter of at least one of Examples 8-13, to optionally include or use, wherein the restricted area is a temporary restricted area and the memory includes further data indicating a start time and end time, and wherein the conflict detection circuitry is further to determine whether a current time is between the start time and end time before determining whether the position is within the polygonal area.

Example 15 can include or use subject matter (such as an apparatus, a method, a means for performing acts, or a device readable memory including instructions that, when performed by the device, can cause the device to perform acts), such as can include or use a method comprising receiving, at conflict detection circuitry and from position determination circuitry, a position of a vehicle in a geographical area that is segmented into discrete cells, determining, by the conflict detection circuitry, whether the position is situated in a cell of the cells that includes a polygonal area representing an extended restricted area within the cell, the extended restricted area including a footprint of a restricted area extended in one or more directions, and the extended restricted area completely within the polygonal area, in response to determining the position is situated within the polygonal area, determining whether the position is situated within the extended restricted area, and in response to determining the position is situated within the extended restricted area, providing one or more signals to transceiver circuitry to cause the transceiver circuitry to transmit an alert indicating that a conflict exists to the vehicle.

Example 16 can include or use, or can optionally be combined with the subject matter of Example 15, to optionally include or use, in response to determining the position is not situated in the polygonal area, determining that no conflict exists.

Example 17 can include or use, or can optionally be combined with the subject matter of at least one of Examples 15-16, to optionally include or use, in response to determining the position is not situated in the extended restricted area, determining that no conflict exists.

Example 18 can include or use, or can optionally be combined with the subject matter of at least one of Examples 15-17, to optionally include or use, wherein the extended restricted area includes the restricted area extended in all directions a distance that is greater than, or equal to, (a) a maximum width or a maximum length of all vehicles in the geographical area plus (2) an error in the received position weighted by a safety factor.

Example 19 can include or use, or can optionally be combined with the subject matter of at least one of Examples 15-18, to optionally include or use, wherein the polygonal area is a rectangle including points defined by a minimum and maximum location of the extended restricted area in a first direction and a minimum and maximum location of the extended restricted area in a second direction, the second direction perpendicular to the first direction.

Example 20 can include or use, or can optionally be combined with the subject matter of at least one of Examples 15-19, to optionally include or use determining, based on the provided position, that a threat to other vehicles exists in the geographical area, and in response to determining the threat exists, producing one or more signals that cause the transceiver circuitry to provide an alert to all vehicles in the geographical area that are not completely within an extended geographical area of the geographical area.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in this document, the terms "first," "second," and "third," etc. are used merely as labels, and are not intended to impose numerical requirements on their objects.

From the foregoing, it will be observed that numerous variations and modifications can be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Although a few embodiments have been described in detail above, other modifications are possible. For example, the logic flows depicted in the FIGS. do not require the particular order shown, or sequential order, to achieve desirable results. Other steps can be provided, or steps can be eliminated, from the described flows, and other components can be added to, or removed from, the described systems. Other embodiments can be within the scope of the following claims.

What is claimed is:

1. A device comprising:

transceiver circuitry;

conflict detection circuitry coupled to the transceiver circuitry, the conflict detection circuitry to:

receive, from position determination circuitry, a position of a vehicle in a geographical area that is segmented into discrete cells;

determine whether the position is situated in a cell of the cells that includes a polygonal area representing an extended restricted area within the cell, the extended restricted area including a footprint of a restricted area extended in one or more directions, and the extended restricted area completely within the polygonal area;

in response to a determination the position is situated within the polygonal area, determine whether the position is situated within the extended restricted area; and in response to a determination the position is situated within the extended restricted area, provide one or more signals to the transceiver circuitry to cause the transceiver circuitry to transmit an alert to the vehicle indicating that a conflict exists.

2. The device of claim 1, wherein the conflict detection circuitry is further to, in response to a determination the position is not situated in the polygonal area, determine that no conflict exists.

3. The device of claim 1, wherein the conflict detection circuitry is further to, in response to a determination the position is not situated in the extended restricted area, determine that no conflict exists.

4. The device of claim 1, wherein the conflict detection circuitry is to retrieve data indicating the extent of the polygonal area from a local memory.

5. The device of claim 1, wherein the extended restricted area includes the restricted area extended in all directions a distance that is greater than, or equal to, (a) a maximum width or a maximum length of all vehicles in the geographical area plus (2) an error in the received position weighted by a safety factor.

6. The device of claim 1, wherein the polygonal area is a rectangle including points defined by a minimum and maximum location of the extended restricted area in a first direction and a minimum and maximum location of the extended restricted area in a second direction, the second direction perpendicular to the first direction.

7. The device of claim 1, wherein the conflict detection circuitry is further to:

determine, based on the provided position, that a threat to other vehicles exists in the geographical area; and in response to the determination the threat exists, produce one or more signals that cause the transceiver circuitry to provide an alert to all vehicles in the geographical area that are not completely within an extended restricted area of the geographical area.

8. A system comprising:

a memory including data regarding a geographical extent of a registered geographical area stored thereon, the data indicating a geographical extent of discrete cells of the registered geographical area, the data further indicating a geographical extent of a restricted area within the geographical area that a vehicle is prohibited from entering, the data further indicating a geographical extent of an extended restricted area within the geographical area that fully surrounds the geographical area, and the data further indicating a polygonal area within the geographical area that fully surrounds the extended restricted area;

position determination circuitry to determine a position of the vehicle in the registered geographical area; and conflict determination circuitry to:

determine, based on the position, to which cell of the discrete cells the position corresponds;

determine if the determined cell includes at least a portion of the polygonal area therein;

in response to a determination the position is situated within the polygonal area, determine whether the position is situated within the extended restricted area; and in response to a determination the position is situated within the extended restricted area, provide one or more signals to transceiver circuitry of the conflict detection circuitry to cause the transceiver circuitry to transmit an alert to the vehicle indicating that a conflict exists.

9. The system of claim 8, wherein the conflict detection circuitry is further to, in response to a determination the position is not situated in the polygonal area, determine that no conflict exists.

10. The system of claim 8, wherein the conflict detection circuitry is further to, in response to a determination the position is not situated in the extended restricted area, determine that no conflict exists.

11. The system of claim 8, wherein the extended restricted area includes the restricted area extended in all directions a distance that is greater than, or equal to, (a) a maximum width or a maximum length of all vehicles in the geographical area plus (2) an error in the position weighted by a safety factor.

12. The system of claim 8, wherein the polygonal area is a rectangle including points defined by a minimum and a maximum location of the extended restricted area in a first direction within the geographical area and a minimum and a maximum location of the extended restricted area in a second direction, the second direction perpendicular to the first direction.

13. The system of claim 8, wherein the extended restricted area is one of a plurality of extended restricted areas and wherein the conflict detection circuitry is further to:

determine, based on the position, that a threat to other vehicles exists in the geographical area; and in response to the determination the threat exists, produce one or more signals that cause the transceiver circuitry to provide an alert to all vehicles in the geographical area that are not completely within an extended restricted area of the extended restricted areas.

14. The system of claim 8, wherein the restricted area is a temporary restricted area and the memory includes further data indicating a start time and end time, and wherein the conflict detection circuitry is further to:

determine whether a current time is between the start time and end time before determining whether the position is within the polygonal area.

15. A method comprising:

receiving, at conflict detection circuitry and from position determination circuitry, a position of a vehicle in a geographical area that is segmented into discrete cells;

determining, by the conflict detection circuitry, whether the position is situated in a cell of the cells that includes a polygonal area representing an extended restricted area within the cell, the extended restricted area including a footprint of a restricted area extended in one or more directions, and the extended restricted area completely within the polygonal area;

in response to determining the position is situated within the polygonal area, determining whether the position is situated within the extended restricted area; and in response to determining the position is situated within the extended restricted area, providing one or more signals to transceiver circuitry to cause the transceiver circuitry to transmit an alert indicating that a conflict exists to the vehicle.

16. The method of claim 15, further comprising, in response to determining the position is not situated in the polygonal area, determining that no conflict exists.

17. The method of claim 15, further comprising, in response to determining the position is not situated in the extended restricted area, determining that no conflict exists.

18. The method of claim 15, wherein the extended restricted area includes the restricted area extended in all directions a distance that is greater than, or equal to, (a) a maximum width or a maximum length of all vehicles in the geographical area plus (2) an error in the received position weighted by a safety factor.

19. The method of claim 15, wherein the polygonal area is a rectangle including points defined by a minimum and maximum location of the extended restricted area in a first direction and a minimum and maximum location of the extended restricted area in a second direction, the second direction perpendicular to the first direction.

20. The method of claim 15, further comprising:

determining, based on the provided position, that a threat to other vehicles exists in the geographical area; and in response to determining the threat exists, producing one or more signals that cause the transceiver circuitry to provide an alert to all vehicles in the geographical area that are not completely within an extended restricted area of the geographical area.

* * * * *